US010010180B2

(12) United States Patent
Anastos

(10) Patent No.: US 10,010,180 B2
(45) Date of Patent: Jul. 3, 2018

(54) CONTAINER MOUNTABLE SUPPORT APPARATUS

(71) Applicant: Chris Anastos, Martinez, CA (US)

(72) Inventor: Chris Anastos, Martinez, CA (US)

( * ) Notice: Subject to any disclaimer, the term of this patent is extended or adjusted under 35 U.S.C. 154(b) by 0 days.

(21) Appl. No.: 14/939,398

(22) Filed: Nov. 12, 2015

(65) Prior Publication Data

US 2016/0242551 A1 Aug. 25, 2016

Related U.S. Application Data

(60) Provisional application No. 62/118,421, filed on Feb. 19, 2015.

(51) Int. Cl.
*A47C 7/02* (2006.01)
*A47C 9/10* (2006.01)

(52) U.S. Cl.
CPC ..... *A47C 7/021* (2013.01); *A47C 9/10* (2013.01)

(58) Field of Classification Search
CPC ..... A47C 7/021
See application file for complete search history.

(56) References Cited

U.S. PATENT DOCUMENTS 3,350,131 A * 10/1967 Tanzer ..... B65D 47/046 206/151
3,751,845 A * 8/1973 van Leeuwen ..... A01K 97/05 206/542
4,295,680 A 10/1981 Grasso
4,379,587 A * 4/1983 Duncan ..... A01K 97/01 297/130
4,760,802 A * 8/1988 Leong ..... A47B 3/06 108/150
4,789,046 A 12/1988 McDowall
4,846,076 A 7/1989 Menges, Sr. et al.
D321,991 S * 12/1991 Menges, Sr. ..... D6/335
5,170,516 A 12/1992 Davison
5,429,265 A 7/1995 Maire et al.
5,518,135 A * 5/1996 Freund ..... B65D 51/24 215/329
5,868,268 A * 2/1999 Walker ..... B65D 55/16 206/509
5,970,651 A 10/1999 Torkilsen et al.
6,209,891 B1 4/2001 Herrmann
6,938,761 B2 9/2005 Nish
7,341,314 B1 * 3/2008 Boyd ..... A47C 9/10 297/188.09
7,467,590 B1 12/2008 Meller
7,597,392 B1 10/2009 Gilmore
8,136,692 B2 * 3/2012 Horsburgh ..... B65D 25/205 206/446
D693,137 S * 11/2013 Bracci ..... D6/349
9,078,526 B1 * 7/2015 Kammeyer ..... A47C 13/00
2010/0052398 A1 * 3/2010 Hanusiak ..... A47C 9/10 297/451.4
2014/0265465 A1 9/2014 Johansson

* cited by examiner

*Primary Examiner* — Timothy J Brindley
(74) *Attorney, Agent, or Firm* — Kilpatrick Townsend & Stockton LLP

(57) ABSTRACT

A padded support for workmen, sportsmen, hobbyists and the like who perform activities in a seated and/or kneeling position for a sustained period of time. The support includes a combined seat and knee board mountable to a container, such as a utility bucket. A recessed groove on the bottom of the support is concentric with the container and mounts to an end of the container.

20 Claims, 3 Drawing Sheets

CONTAINER MOUNTABLE SUPPORT APPARATUS

CROSS-REFERENCE TO RELATED APPLICATION

This application is a non-provisional application claiming the benefit of U.S. Application No. 62/118,421, filed Feb. 19, 2015, entitled "CONTAINER MOUNTABLE SUPPORT APPARATUS," which is hereby incorporated by reference in its entirety.

BACKGROUND OF THE INVENTION

This disclosure relates generally to supports for workmen, sportsmen, hobbyists and the like who perform activities in a seated and/or kneeling position for a sustained period of time, and more specifically to a combined seat and knee board apparatus mountable to a container, such as a utility bucket.

Utility buckets are ubiquitous in various types of work and recreational environments. For example, construction workers use utility buckets to carry tools from one job site or work station to another and to store tools or other implements where they are protected against moisture or harmful exposure to chemicals or the environment. Utility buckets are also widely used by sportsmen in the field. For example, fishermen traditionally carry buckets into a fishing area, sometimes containing equipment inside, and use them to carry their catches back home at the end of the day. Hobbyists such as gardeners also use utility buckets to transport and hold tools while tending to their gardens and to collect pulled weeds and other yard debris.

The use of knee pads and cushioned knee boards is commonly encountered in many of the same work and recreational environments in which utility buckets are utilized, particularly when the task being performed is repetitive or is performed over a long period of time. For example, in the work and recreational scenarios described above, a construction worker uses knee pads to protect and provide comfort for his knees while performing repetitive tasks along the floor line at a job site, and a gardener uses a padded kneeboard while kneeling to remove weeds from a garden. One drawback to using knee pads, however, is that they typically are strapped to a worker's leg and regularly shift position with movement. This requires frequent readjustment in the field. Because knee boards are not attached to the user, they do not present the same inconvenience; however, they are not as commonly used in harsh work environments because they are not typically as durable as knee pads.

In circumstances where repetitive or sustained activity is not performed in a kneeling position, the use of buckets as makeshift seats is a common practice. The use of a bucket as a seat typically involves sitting on an attached bucket lid or inverting the bucket to use the bottom as a seat. For example, an auto mechanic using a bucket to carry his tools empties the bucket and inverts it to be used as a seat while performing maintenance on the brake system of a truck. However, inverting the bucket to be used as a seat is problematic for many reasons. For example, it is inefficient to remove the contents of a bucket every time it is to be used as a seat, and doing so in some circumstances may expose the contents to harmful environments or create a safety hazard. Use of a bucket in this manner is also uncomfortable as buckets are typically made of hard plastic or metal and provide no cushioning. Use of an attached bucket lid as a seat is also uncomfortable for the same reason. To address these problems, bucket covers adapted to be used as seats are widely available in the marketplace.

Covers for buckets adapted to be used as seats typically fit onto the top of a bucket and provide only a small area on which to sit. A portion of the area may be padded or adapted to provide a small work area like a table top. However, many of these covers fail to provide an adequately large area on which to more evenly distribute the weight of the user while performing varied tasks, particularly those involving awkward postures and vigorous movements, and are unstable in some circumstances, such as when a user is not actively sitting on the cover. In addition, these covers fail to provide a safe and comfortable support for individuals performing repetitive or lengthy tasks in a kneeling position. For these reasons, there is a need for a versatile, comfortable, stable and protective support for workers, hobbyists and the like who perform repetitive and lengthy tasks while using a bucket. The present invention satisfies this and other needs.

BRIEF SUMMARY OF THE INVENTION

The invention described herein provides an apparatus for supporting individuals, such as workmen, sportsmen, hobbyists and the like, who perform activities in a seated and/or kneeling position for a sustained period of time. The apparatus provides a versatile seat that is removably mountable on a container. The apparatus also provides a versatile knee board that is removably mountable on a container. The apparatus also provides a combined seat, knee board, and container lid. In some embodiments, the container is a bucket or pail. In other embodiments, the container is a standard utility bucket, such as a 1, 2, 3, 4, 5, or 10 gallon bucket. In yet other embodiments, the container is a drum such as an oil or fuel drum.

The seat and knee board comprises a top member, a weight bearing bottom member, and a recessed cylindrical groove that is configured to fit onto an end of a container. The top member comprises a pad that includes cushioning to provide a comfortable area for seating and kneeling. In some embodiments, the top member is a foam pad. In one aspect, the foam pad is a polyethylene foam pad. The bottom member comprises a rigid bottom surface and recessed cylindrical groove that is concentric with the container onto which the apparatus is mountable. The bottom member is coupled to the top member to provide a protective and weight bearing support for the top member. In some embodiments, the rigid bottom surface is a hard plastic material such as high-density polyethylene, polypropylene or polycarbonate. The cylindrical groove is configured to receive an end of the container. In one aspect, the end of the container is the top end of the container. In another aspect, the end of the container is the bottom end of the container. In many aspects, the end of the container is a rim of the container.

The invention described herein further provides a method of using a container as a support, the method comprising: removably mounting a support apparatus to a rim of a container, wherein the support apparatus comprises a top member including a pad, a weight bearing bottom member coupled to the top member, the bottom member having a rigid bottom surface, and a cylindrical groove in the rigid bottom surface, wherein the cylindrical groove is concentric with the container and configured to receive the rim of the container; and using the container as a support.

The seat and knee board can be used when mounted to the container as a seat or lid and when removed from the container as a knee board. When used as a seat or lid, the apparatus is fitted onto the top of an upright container with the innermost circular plane of the cylindrical groove resting on the edge of the top circular plane of the container. Alternatively, the apparatus may be used as a seat when fitted onto the bottom of an inverted container with the innermost circular plane of the cylindrical groove resting on the edge of the circular plane of the bottom of the container. When used as a knee board, the apparatus is removed from the container and placed on the ground. When used as a seat and knee board, the top member provides a cushion for the user and the bottom member supports the weight of the user while protecting the cushion from damage or wear where it comes into contact with the end of the container or ground. When used as a lid, the bottom member covers the opening of the container.

Other objects, features, and advantages of the present invention will be apparent to one of skill in the art from the following detailed description and figures.

DETAILED DESCRIPTION OF THE INVENTION

The present invention provides for a padded support for workmen, sportsmen, hobbyists and the like who perform activities in a seated and/or kneeling position for a sustained period of time. The support includes a combined seat and knee board mountable to a container, such as a utility bucket. A recessed groove on the bottom of the support is concentric with the container and mounts to an end of the container.

Figure 1:
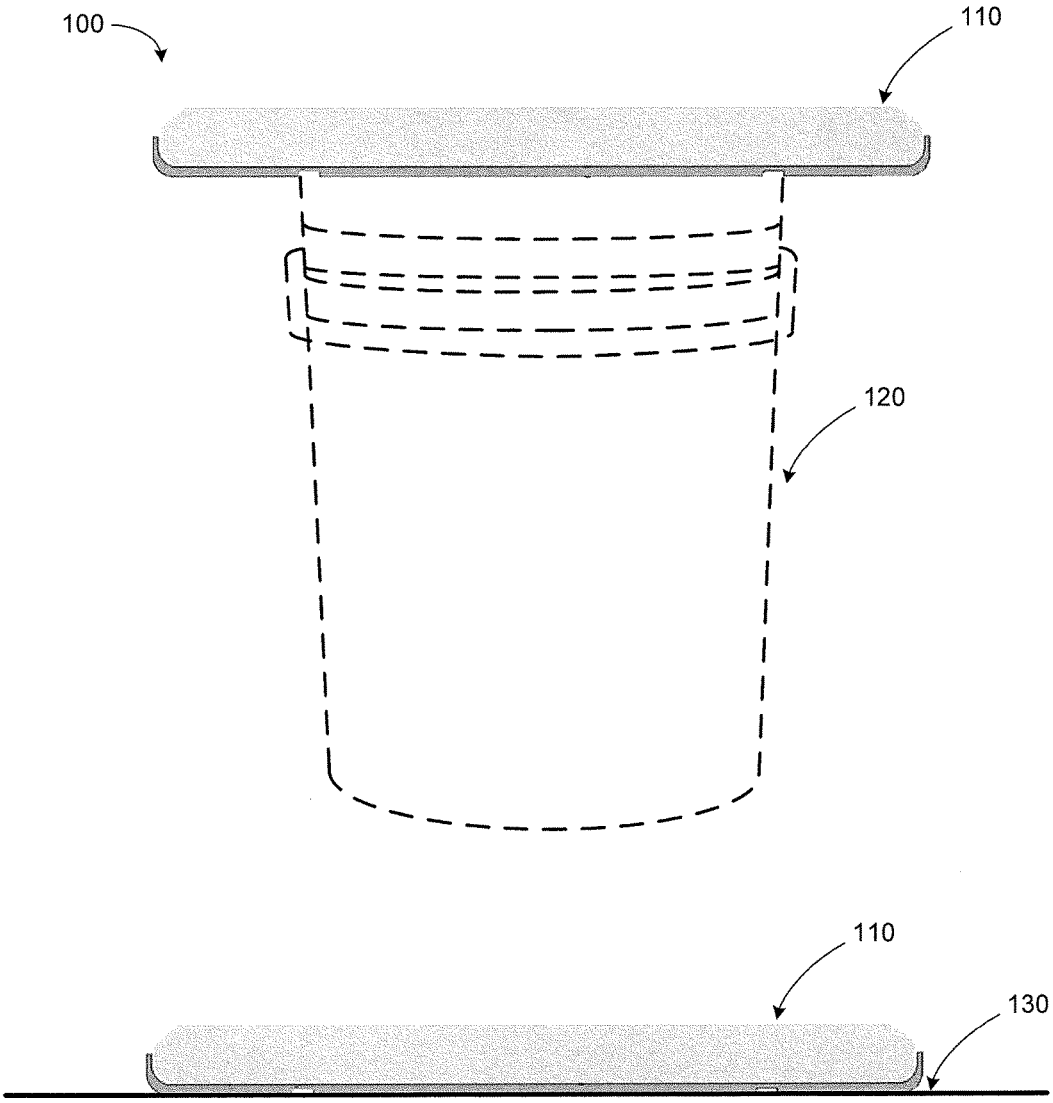
FIG. 1 is a cross-sectional view of a container mountable support apparatus mounted to a container in accordance with an embodiment of the invention.

As illustrated in FIG. 1, the apparatus 100 of the present invention comprises, consists essentially of, or consists of a versatile seat 110 that is removably mountable onto a container 120 where it can be used as a seat. In one aspect, the apparatus 100 of the present invention comprises, consists essentially of, or consists of a versatile knee board 110 that is mountable onto a container 120 and can be removed from the container to be placed on the ground 130 or other flat surface and used as a knee board 110. In another aspect, the apparatus 100 of the present invention comprises, consists essentially of, or consists of a combined seat, knee board, and container lid that is removably mountable onto a container 120 to keep it closed. In some embodiments, the container 120 is a bucket or pail. In other embodiments, the container 120 is a standard utility bucket, such as a 1, 2, 3, 4, 5, or 10 gallon bucket. In yet other embodiments, the container 120 is a drum such as an oil or fuel drum. In one aspect, the container is a cylindrical container. In another aspect, the container is a square or rectangular container.

The present invention also comprises, consists essentially of or consists of a method of using a container as a support, the method comprising: removably mounting a support apparatus to a rim of a container, wherein the support apparatus comprises a top member including a pad, a weight bearing bottom member coupled to the top member, the bottom member having a rigid bottom surface, and a cylindrical groove that is recessed in the rigid bottom surface, wherein the cylindrical groove is concentric with the container and configured to receive the rim of the container; and using the container as a support.

In the example of FIG. 1, the apparatus 100 can be used when mounted to the container 120 as a seat 110 or lid and when removed from the container as a knee board 110. When used as a seat 110 or lid, the apparatus 100 is fitted onto the top of an upright container 120 with the innermost circular plane of the recessed cylindrical groove resting on the edge of the top circular plane of the container 120. Alternatively, the apparatus 100 may be used as a seat when fitted onto the bottom of an inverted container with the innermost circular plane of the cylindrical groove resting on the edge of the circular plane of the bottom of the container. When used as a knee board 110, the apparatus 100 is removed from the container 120 and placed on the ground 130 or other flat surface. When used as a seat and knee board, the top member provides a cushion for the user and the bottom member supports the weight of the user while protecting the cushion from damage or wear where it comes into contact with the end of the container 120 or ground 130.

Figure 2:
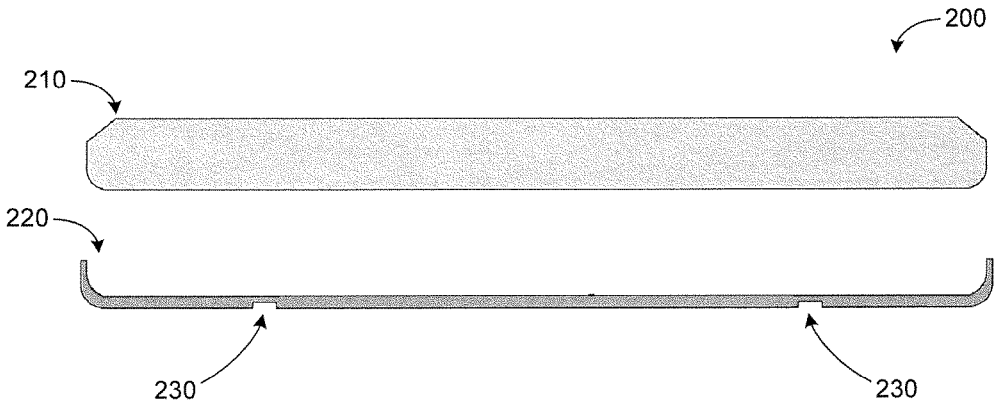
FIG. 2 is a cross-sectional view of a container mountable support apparatus in accordance with an embodiment of the invention.

As illustrated in FIG. 2, the seat and knee board 200 comprises a top member 210, a weight bearing bottom member 220, and a groove 230 that is configured to fit onto an end of a container. The top member 210 comprises a pad that includes cushioning to provide a comfortable area for seating and kneeling. In some embodiments, the top member 210 is a foam pad. In one aspect, the foam pad is a polyethylene foam pad. The bottom member 220 comprises a rigid bottom surface and recessed groove 230 that is concentric with a container on which it is to be mounted. In some embodiments, the groove 230 is cylindrical and is configured to fit onto a rim of a cylindrical container, such as a utility bucket. In some embodiments, the groove 230 is square or rectangular and is configured to fit onto an end of a square or rectangular container, such as a storage tub.

Figure 3:
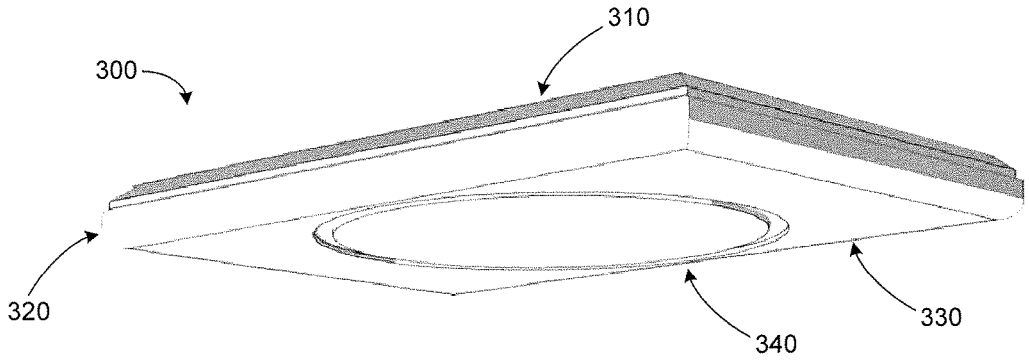
FIG. 3 is a perspective view of a container mountable support apparatus in accordance with an embodiment of the invention.

As illustrated in FIG. 3, the bottom member 320 comprises a rigid bottom surface 330 and is coupled to the top member 310 to provide a protective and weight bearing support for the top member 310 and user of the apparatus 300. In one aspect, the bottom member 320 is coupled to the top member 310 with a permanent or semi-permanent adhesive, such as an industrial or commercially available foam adhesive or epoxy. In another aspect, the bottom member 320 fits onto and cups the top member 310. In some embodiments, the rigid bottom surface 330 is a hard plastic material such as high-density polyethylene, polypropylene or polycarbonate. The groove 340 is configured to receive an end of a container. In some embodiments, the groove has a depth of about 1/16 to 1/4 inch, such as 1/8 inch, and a width of about 1 to 1/4 inch, such as 1/2 inch. In one aspect, the groove is recessed to a depth of about one quarter to three quarters the thickness of the bottom member, such as a depth of half the thickness of the bottom member. For example, in one embodiment, the bottom member comprises a thickness of one inch and the groove is recessed to a depth of half an inch. In some embodiments, the groove has a width to depth ratio that is at least 1:4. The end of the container can be either the top end or the bottom end of the container. For example, if the container is right side up, the apparatus 300 is mountable onto the top of the container and if the container is inverted, the apparatus 300 is mountable onto the bottom of the container.

Figure 4:
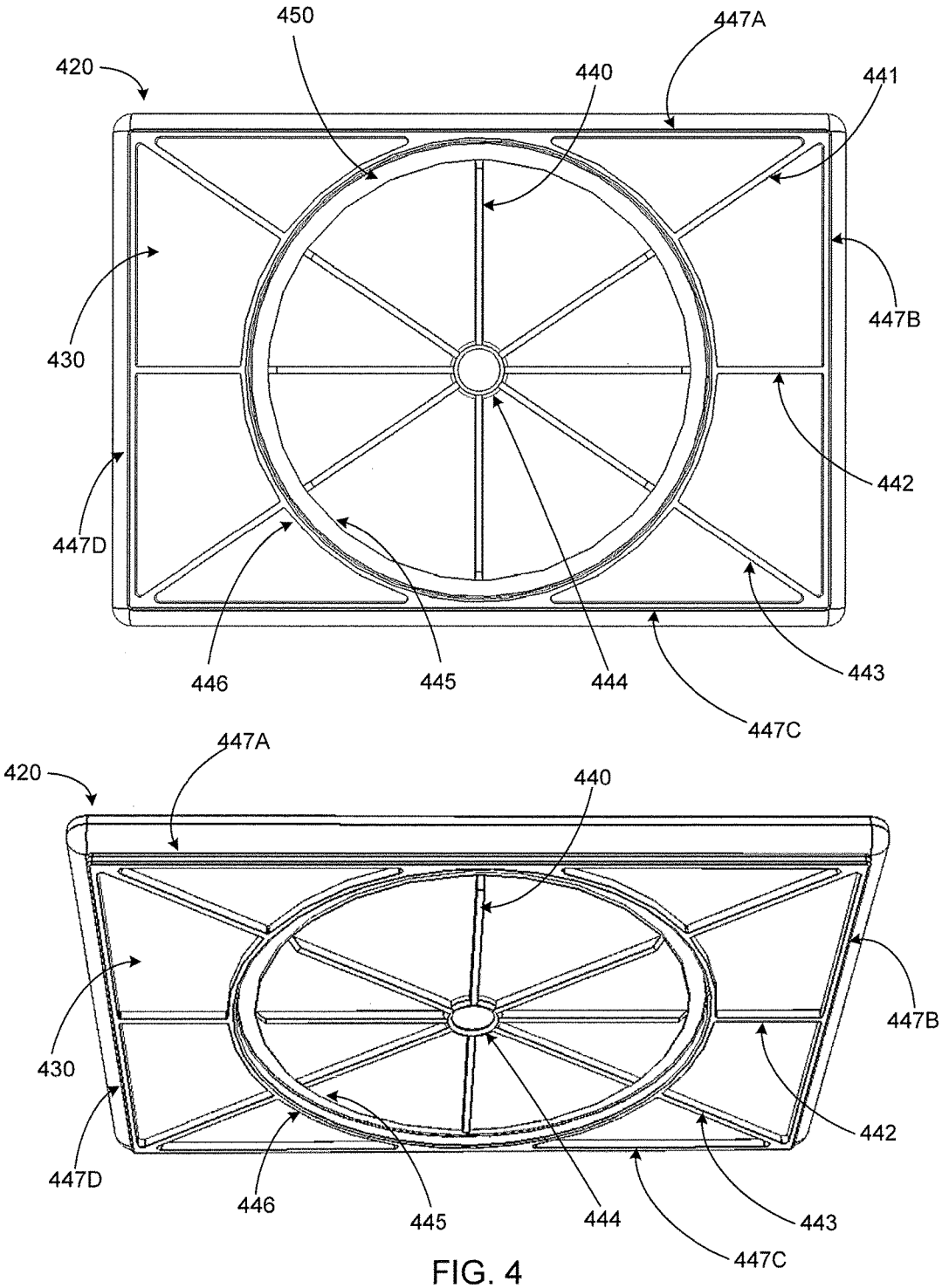
FIG. 4 is a bottom view of a container mountable support apparatus in accordance with an embodiment of the invention.

In various embodiments, the bottom member 320 comprises a rigid bottom surface 330 and a plurality of ribs or gussets to improve stability of the apparatus 300 by improving stiffness in the bottom member 320. For example, as illustrated in FIG. 4, the bottom member 420 comprises a rigid bottom surface 430 and a plurality of linear and concentric ribs 440-446 and 447A-D on the rigid bottom surface 430. In one aspect, each of the plurality of ribs 440-446 and 447A-D has a thickness that ranges from about 30 to 80 percent of the thickness of the bottom member 420. In another aspect, each of the plurality of ribs 440-446 and 447A-D has a height of about 1 to 3 times the thickness of the bottom member 420. In yet another aspect, an annular region 450 between two concentric ribs 445-446 on the rigid bottom surface 430 comprises the groove 340 configured to receive an end of a container. In other embodiments, gussets may be used in place of or in conjunction with the plurality of ribs 440-446 and 447A-D. In various aspects, the plurality of ribs 440-446 and 447A-D or gussets imparts added stiffness to the bottom member 420 and improves the weight bearing capability of the apparatus 300, thereby allowing its manufacture with thinner, lighter weight and more cost-effective materials than would be allowed without the ribs 440-446 and 447A-D or gussets.

Returning to the illustration of FIG. 3, the apparatus 300 has a width that is at least as wide as the container on which it is mountable and the ridge 340 fits onto the entire outer surface of the edge of the container so that the innermost plane of the groove 340 rests on the entire edge of the top plane of the container. For example, the apparatus 300 is fitted onto a utility bucket by fitting the groove 340 onto the top end of the bucket and seating it firmly onto the bucket until the innermost plane of the groove 340 comes to rest on the upper edge of the bucket, providing a stable seat 310 for the user and lid for the bucket. In another aspect, the apparatus 300 has a length to width ratio that is at least 1:1.4 to provide a wide and stable platform on which to distribute the weight of the user while being used as a seat and/or a knee board. In some embodiments, the apparatus has a length of about 17 to 24 inches, such as 18¼ inches, a width of about 12 to 14 inches, such as 12½ inches, and a height of between 1 and 6 inches, such as 1½ inches.

What is claimed is:

1. A bucket mountable seat and kneeboard apparatus comprising:

a top member including a pad;

a weight bearing bottom member coupled to the top member, the bottom member having a rigid bottom surface comprising a plurality of linear ribs and an inner and an outer circular rib, wherein a set of the plurality of linear ribs and said inner and outer circular rib are arranged in a hub and spoke configuration, and an additional set of the plurality of linear ribs comprises a rectangular frame around the hub and spoke configuration;

a cylindrical groove in the rigid bottom surface intersecting the set of the plurality of linear ribs, wherein the cylindrical groove is concentric with a bucket and the cylindrical groove is configured to receive an entire rim of the bucket and to contact an outermost plane of an end of the bucket with an innermost plane of the cylindrical groove; and wherein the apparatus is configured to function as each of a bucket mountable seat, a kneeboard, and a container lid.

2. The apparatus of claim 1, wherein the pad comprises a foam pad.

3. The apparatus of claim 1, wherein the pad comprises a polyethylene foam pad.

4. The apparatus of claim 1, wherein the rigid bottom surface comprises high-density polyethylene.

5. The apparatus of claim 1, wherein the rigid bottom surface comprises polypropylene.

6. The apparatus of claim 1, wherein the rigid bottom surface comprises polycarbonate.

7. The apparatus of claim 1, wherein the bucket is a drum.

8. The apparatus of claim 1, wherein the bottom member has a width that is at least equal to a diameter of the bucket.

9. The apparatus of claim 1, wherein a length to width ratio of the apparatus is at least 1:1.4.

10. A method of using a bucket as a support comprising:

removably mounting a seat and kneeboard apparatus to a rim of a bucket, wherein the seat and kneeboard apparatus comprises a top member including a pad, a weight bearing bottom member coupled to the top member, the bottom member having a rigid bottom surface comprising a plurality of linear ribs and an inner and an outer circular rib, wherein a set of the plurality of linear ribs and said inner and outer circular rib are arranged in a hub and spoke configuration, and an additional set of the plurality of linear ribs comprises a rectangular frame around the hub and spoke configuration, a cylindrical groove in the rigid bottom surface intersecting the set of the plurality of linear ribs, wherein the cylindrical groove is concentric with the bucket and the cylindrical groove is configured to receive the entire rim of the bucket and to contact an outermost plane of an end of the bucket with an innermost plane of the cylindrical groove, and wherein the apparatus is configured to function as each of a bucket mountable seat, a kneeboard, and a container lid; and using the bucket as a support.

11. The method of claim 10, wherein the pad comprises a foam pad.

12. The method of claim 10, wherein the pad comprises a polyethylene foam pad.

13. The method of claim 10, wherein the rigid bottom surface comprises high-density polyethylene.

14. The method of claim 10, wherein the rigid bottom surface comprises polypropylene.

15. The method of claim 10, wherein the rigid bottom surface comprises polycarbonate.

16. The apparatus of claim 1, wherein the weight bearing bottom member cups the top member.

17. The apparatus of claim 1, wherein the hub and spoke configuration is on the rigid bottom surface of the bottom member.

18. The method of claim 10, wherein removably mounting the seat and kneeboard apparatus to the rim of the bucket comprises fitting the cylindrical groove onto an end of the bucket so that at least a portion of the innermost plane of the cylindrical groove contacts at least a portion of the outermost plane of the end of the bucket.

19. The method of claim 10, wherein the weight bearing bottom member cups the top member.

20. The apparatus of claim 1, wherein the end of the bucket is either a top end of the bucket or a bottom end of the bucket.

* * * * *